United States Patent [19]

Meguro

[11] Patent Number: 4,576,701

[45] Date of Patent: Mar. 18, 1986

[54] NICKEL ELECTROPLATING ANODE AND METHOD OF FORMING

[76] Inventor: Takeo Meguro, 16-11, Nishiogi Minami 4-chome, Suginami-ku, Tokyo, Japan

[21] Appl. No.: 625,088

[22] Filed: Jun. 27, 1984

[51] Int. Cl.[4] ..... C25D 17/12; C25B 11/02; B21D 22/00; H01R 43/00

[52] U.S. Cl. ..... 204/280; 72/360; 72/365; 204/292; 29/825

[58] Field of Search ..... 204/280, 292; 29/825; 72/70–71, 89, 306, 318, 359–360, 365

[56] References Cited

U.S. PATENT DOCUMENTS 1,751,630 3/1930 Harshaw et al. ..... 204/292

2,274,056 2/1942 Geiger ..... 204/292

3,300,396 1/1967 Walker ..... 204/280 X 3,791,188 2/1974 Deussen ..... 72/360 X

*Primary Examiner*—Donald R. Valentine

*Attorney, Agent, or Firm*—Pearne, Gordon, Sessions, McCoy, Granger & Tilberry

[57] ABSTRACT

This invention relates to a plating electrolytic nickel anode which is in the form of a sphere by directly and plastically deforming a plate-like electrolytic anode of high purity. This invention further relates to a method of producing a plating electrolytic nickel anode in which a plate-like electrolytic nickel anode is formed into a cylindrical body by upsetting and thereafter the thus formed cylindrical body is plastically deformed into a spherical body.

6 Claims, 5 Drawing Figures

NICKEL ELECTROPLATING ANODE AND METHOD OF FORMING

BACKGROUND OF THE INVENTION

In the prior art, a plating electrolytic nickel anode is used in the form of a plate which is produced by electrolytic purification or by electrolytic picking or in the form of chips which are formed by cutting a plate-like nickel anode. The electrolytic nickel anodes are contained in a pair of titanium basckets and immersed together with the titanium baskets in plating solution. Articles to be plated are transferred between the baskets while a voltage is applied between them so that nickel is electrolytically plated on the articles.

However, the plate-like or chipped electrolytic nickel anodes have bridge-phenomenon produced in the baskets while electrolysed and ionized in the plating solution. Thus, the electrolytic nickel anodes are only partially dissolved where they react with cathodes, which causes a passive state of the anodes to be produced and therefore the effectiveness of the current to be lowered. Therefore, the prior electrolytic nickel anodes have a disadvantage of failing to produce a uniform plating layer.

In order to avoid the disadvantage of the prior nickel anodes, there has been proposed a spherical electrolytic nickel anode which is conventionally produced by melting an electrolytically purified plate-like electrolytic nickel anode or metallic nickel powder and then by moulding it into the spherical nickel anode. However, when the spherical nickel anode is produced by moulding, a small quantity of silicon and/or carbon is required to be added to the nickel material in order to meet moulding conditions such as flow of molten metal and proper moulding. Therefore, this prior method could not produce electrolytic nickel anode of high purity having more than 99.5% by weight of Ni including Co. Furthermore, nickel material is required to be slightly oxidized by air on its melting to form a solution and to have a small quantity of sulfur added thereto to produce depolarized nickel in order to produce an active plating nickel anode. It will be noted that this disadvantageously requires many complicated steps of melting, surface-cutting, rolling, cutting, surface-polishing and acid-cleaning. In addition thereto, the depolarized nickel produced by the melting process has a lack of uniformity of its activity, has high porosity because part of the material fails to be dissolved due to base potential and loses much metallic component because of sliming ratio having more than 10 times the amount of sulfur included in the nickel than that produced by the electrolytic process.

SUMMARY OF THE INVENTION

Accordingly, it is a principal object of the invention to provide a plating electrolytic nickel anode of a sphere produced without moulding so as to have high purity and predetermined diameter.

It is another object of the invention to provide a method of producing a plating electrolytic nickel anode of a sphere without moulding so as to have a predetermined diameter.

In accordance with one aspect of the invention, there is provided a plating electrolytic nickel anode comprising a spherical body produced by directly and plastically deforming plate-like electrolytic nickel anode of high purity.

In accordance with another aspect of the invention, there is provided a method of producing a plating elelctrolytic nickel anode comprising the steps of deforming a plate-like electrolytic nickel anode of high purity into a cylindrical body by upsetting; and placing said cylindrical body in a spherical die to plastically deform said cylindrical body into a spherical body.

BRIEF DESCRIPTION OF THE DRAWINGS

The above and other objects and features of the invention will be apparent from the description of the embodiments taken along with the accompanying drawings in whcih.

DETAILED DESCRIPTION OF THE EMBODIMENT

Figure 1A:
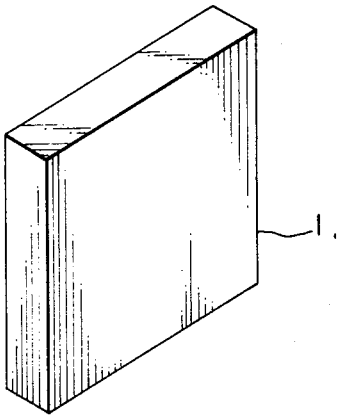
FIGS. 1A through 1C sequentially illustrate the steps of producing a plating electrolytic nickel anode of the invention.
Figure 1B:
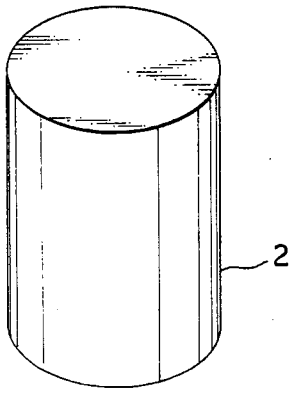
Figure 1C:
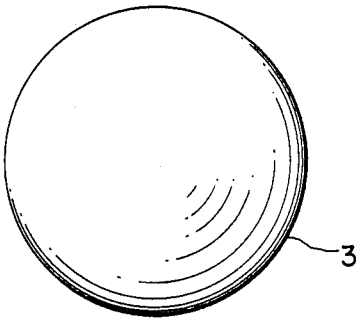

As shown in FIG. 1A, there is prepared a plate-like electrolytic nickel anode 1 of high purity having Ni including Co of more than 99.9% weight. The plate-like electrolytic nickel anode has the thickness, width and length determined in accordance with the desired spherical body. It may have the thickness of 10 to 12 mm, the width of 900 mm and the length of 900 mm, for example. The plate-like electrolytic nickel anode 1 is upset to form a cylindrical body 2 as shown in FIG. 1B.

Thereafter, the cylindrical body 2 is placed in a spherical die of forging means having a predetermined diameter to forge the cylindrical body 2 into a desired spherical body 3 for an electrolytic nickel anode. It should be noted that the forging may be either cold forging or hot forging. It will be understood that the cylindrical body 2 may be deformed alternatively by rolling.

With the spherical electrolytic nickel anode produced by forging or rolling, it will be noted that the spherical electrolytic anode of high purity can be easily produced. It should be noted that the electrolytic nickel anode of high quality can be produced with the desired diameter because an impurity is never added to the material during its manufacture, which occurs when the spherical electrolytic nickel anode is conventionally produced by melting and moulding.

Thus, it will be noted that since the spherical electrolytic nickel anode can be easily produced according to the invention, it can be more easily placed in an anode basket and that bridge-phenomenon can be prevented in the anode basket. Furthermore, it will be noted that the spherical electrolytic nickel anode can be inexpensively produced.

Figure 2:
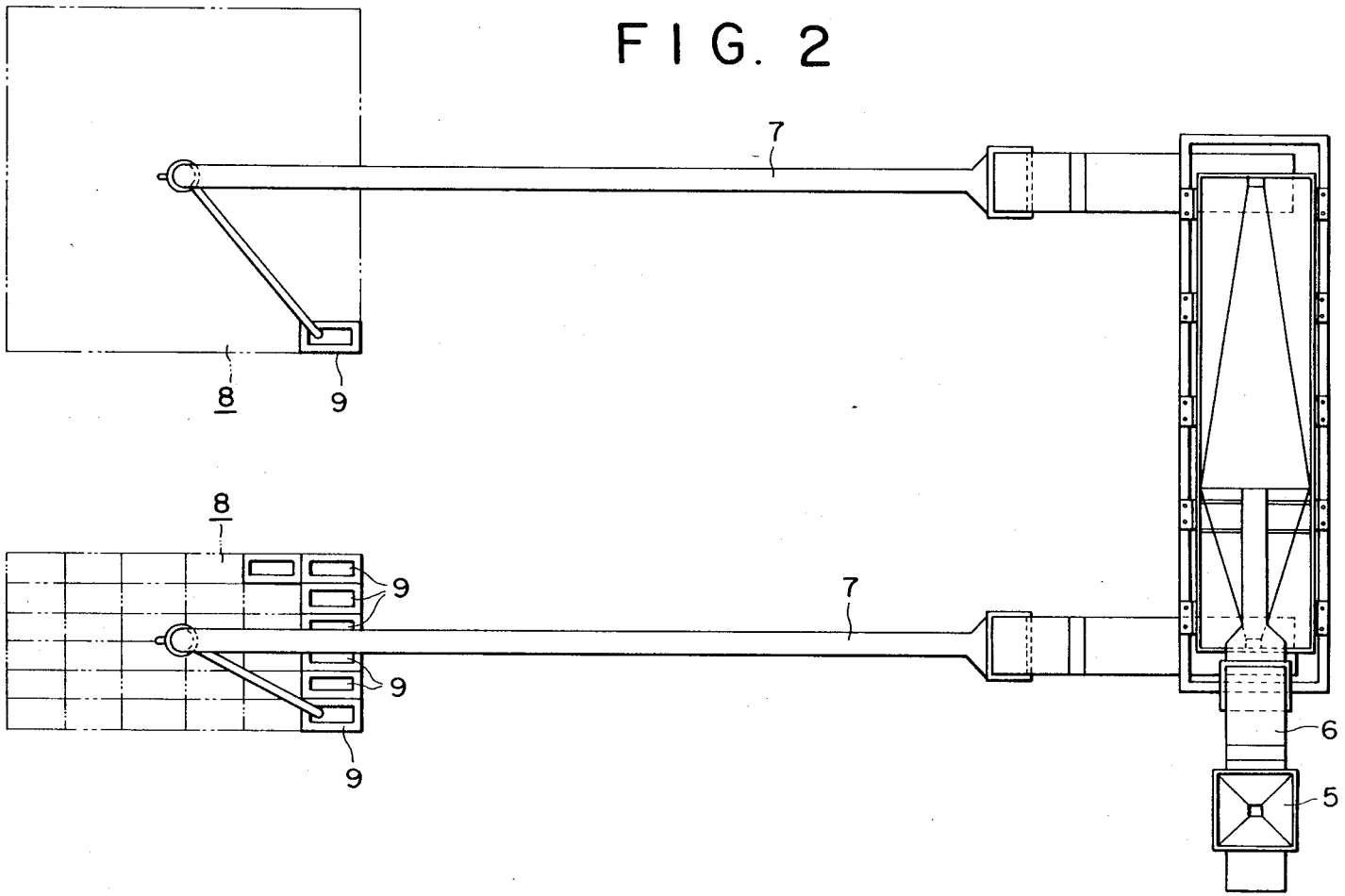
FIG. 2 is a plan view of an automatic feeding apparatus for plating electrolytic nickel anodes.
Figure 3:
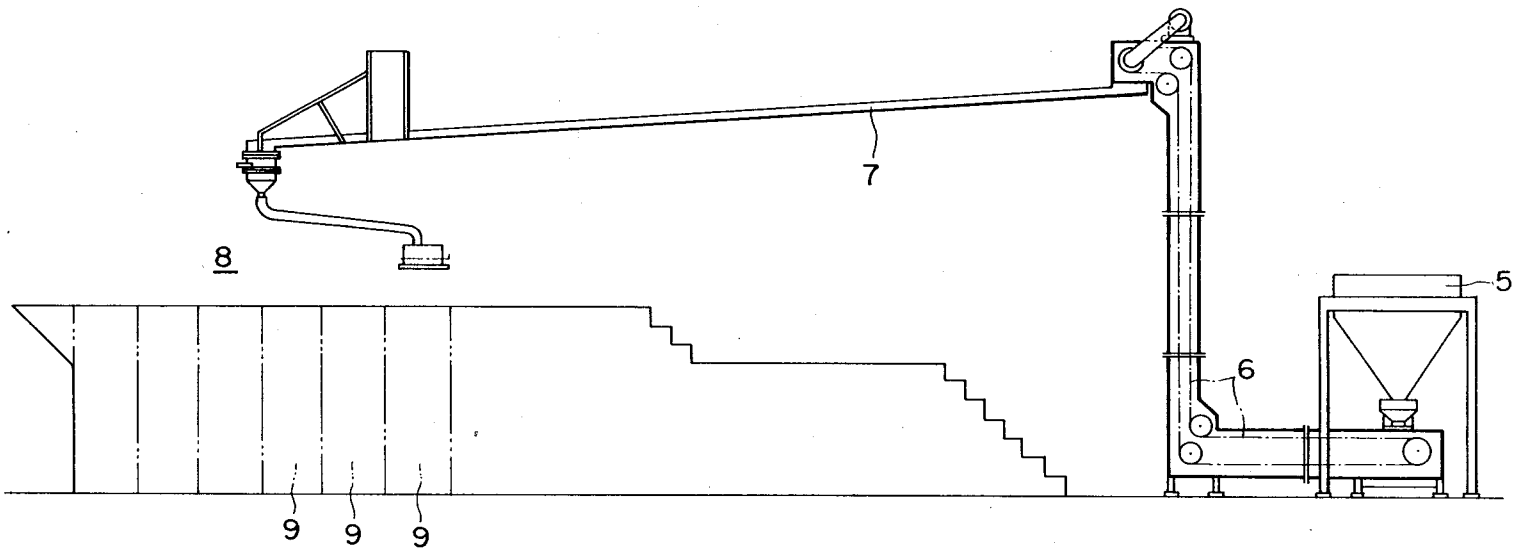
FIG. 3 is a side elevational view of the apparatus of FIG. 2.

FIGS. 2 and 3 show an apparatus for automatically feeding the spherical nickel anodes into the anode basket in electrolytic baths. The spherical electrolytic nickel anode 3 are stored in a receiving hopper 5, picked up by a belt conveyor 6 to be supplied through chutes 7 into the anode basket 9 in the electrolytic baths 8. It will be noted that the spherical electrolytic nickel anodes 3 can be effectively rolled without stopping of rolling halfway, which causes the effectiveness of the operation to be improved.

Although some preferred embodiments of the invention have been illustrated and described with reference to the accompanying drawings, it will be understood by those skilled in the art that they are by way of example, and that various changes and modifications may be made without departing from the spirit and scope of the invention, which is intended to be defined only by the appended claims.

What is claimed is:

1. A plating electrolytic nickel anode comprising a spherical without melting and casting body produced by directly and plastically deforming a plate-like electrolytic nickel anode of high purity.

2. A plating electrolytic nickel anode as set forth in claim 1, wherein said plate-like electrolytic nickel anode is deformed by forging.

3. A plating electrolytic nickel anode as set forth in claim 1, wherein said plate-like electrolytic nickel anode is deformed by rolling.

4. A method of producing a plating electrolytic nickel anode comprising the steps of:

deforming a plate-like electrolytic nickel anode of high purity into a cylindrical body by upsetting without melting and casting;

and placing said cylindrical body in a spherical die to plastically deform it into a spherical body.

5. A method of producing a plating electrolytic nickel anode as set forth in claim 4, wherein said cylindrical body is deformed by forging.

6. A method of producing a plating electrolytic nickel anode as set forth in claim 4, wherein said cylindrical body is deformed by rolling.

* * * * *

UNITED STATES PATENT AND TRADEMARK OFFICE

CERTIFICATE OF CORRECTION

PATENT NO. : 4,576,701

DATED : March 18, 1986

INVENTOR(S) : Takeo Meguro

It is certified that error appears in the above-identified patent and that said Letters Patent are hereby corrected as shown below:

Column 1, line 11, "basckets" should be --baskets--
Column 1, line 12, before "plating" insert --a--.
Column 1, line 38, after "produce" insert --an--
Column 2, lines 4 and 5, "elelctrolytic" should be --electrolytic--
Column 2, line 28, after "99.9%" insert --by--

In the claims:

Claim 1, line 2, delete "without melting and casting"
Claim 1, line 3, after "deforming" insert --, without melting and casting--

Signed and Sealed this

*Twelfth* Day of *August 1986*

[SEAL]

*Attest:*

DONALD J. QUIGG

*Attesting Officer*

*Commissioner of Patents and Trademarks*